US006223452B1

(12) United States Patent
Hamand

(10) Patent No.: US 6,223,452 B1
(45) Date of Patent: May 1, 2001

(54) CLOTHES DRYER WITH EMISSIVE COATING

(75) Inventor: Michael A. Hamand, Newton, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/438,745

(22) Filed: Nov. 11, 1999

(51) Int. Cl.[7] ..... F26B 3/34

(52) U.S. Cl. ..... 34/267; 34/269; 34/598; 34/602; 34/604; 34/420

(58) Field of Search ..... 34/266, 267, 269, 34/598, 602, 603, 604, 418, 420; 362/92, 26, 31

(56) References Cited

U.S. PATENT DOCUMENTS

| | | | | |
|---|---|---|---|---|
| 2,434,886 | | 1/1948 | Pugh | 34/60 |
| 2,453,859 | | 11/1948 | Pugh | 34/60 |
| 4,182,050 | | 1/1980 | Righi | 34/60 |
| 4,523,387 | * | 6/1985 | Mahan | 34/261 |
| 4,899,264 | * | 2/1990 | Ries et al. | 362/92 |
| 5,495,681 | * | 3/1996 | Paradis | 34/602 |
| 5,664,340 | | 9/1997 | Brown | 34/275 |
| 5,953,831 | * | 9/1999 | Yu | 34/269 |
| 6,088,932 | * | 6/2000 | Adamski et al. | 34/274 |

OTHER PUBLICATIONS

*Low–E Finish Hits U.S. Market*, Paul Thompson/General Manager, Radiance, ChemRex, Inc., Shakopee, Minn., May 1998 (4 pages).

* cited by examiner

*Primary Examiner*—Stephen Gravini
(74) *Attorney, Agent, or Firm*—Zarley, McKee, Thomte, Voorhees & Sease

(57) ABSTRACT

An improved clothes dryer has a rotatable drum with an emissive coating on the drum to reflect energy from a heat source, such as a radiant infrared lamp, inside the dryer. By reflecting the energy inside the rotatable drum, the rate of heat transfer is increased, thus increasing drying rate and increasing the energy efficiency of the dryer. Convection air can be used in combination with the infrared heat to further enhance drying.

16 Claims, 3 Drawing Sheets

CLOTHES DRYER WITH EMISSIVE COATING

BACKGROUND OF THE INVENTION

1. Field of the Invention

The present invention relates to an improved clothes dryer. More particularly, the present invention relates to a clothes dryer having an interior coated with a low emissive coating and having a supplemental infrared radiant energy source to increase the rate of heat transfer from the wet clothes, and thereby decrease the drying time of the dryer.

2. Problems in the Art

Conventional clothes dryers typically utilize forced convection heating to dry clothes in a rotating drum. While such convection drying is effective, it is not necessarily energy efficient. The convection drying method is also limited as the cloth temperature approaches the wet-bulb temperature in the dryer drum.

The use of infrared radiant energy to dry clothes in a clothes dryer has been described, but has not been commercially successful. For example, U.S. Pat. No. 2,434,886 discloses a clothes dryer which uses near infrared ray lamps to dry clothes. Also, U.S. Pat. No. 2,453,859 discloses a clothes dryer using near infrared ray lamps for quickly drying clothes and cooling plates for removing moisture from the air. Infrared energy heats the water, as opposed to convection energy, which heats the air. The infrared drying method is not limited to the wet-bulb temperature.

It is well known that water molecules have stretching and bending bonding characteristics. By using a true infrared wavelength, the stretching and bending bonding characteristics of the water molecules can be maximized. By stretching and bending the water molecules, the molecule absorbs energy to drive moisture from the clothes, thus drying the clothes.

One problem encountered with the prior art clothes dryers is the loss of a large percentage of the convection or radiant energy through the wall of the rotatable drum in the dryer. The loss of this radiant energy produces inefficient drying, which increases operating costs of the dryer.

3. Features of the Invention

A general feature of the present invention is a clothes dryer that has an emissive coating on the interior surface of the rotatable drum or basket.

A further feature of the present invention is the provision of the emissive coating having a low radiance emissive value on the interior wall of the rotatable drum of a clothes dryer.

A further feature of the present invention is the provision of a clothes dryer having both an infrared heat source and a convectional heat source.

A further feature of the present invention is the provision of an emissive coating on the interior surface of the access door of the clothes dryer.

A further feature of the present invention is the provision of a clothes dryer having an increased rate of drying.

A further feature of the present invention is the provision of a clothes dryer with an increased rate of heat transfer.

A further feature of the present invention is the provision of a clothes dryer that is more energy efficient.

A further feature of the present invention is the provision of a dryer with a rotatable drum that minimizes energy escaping from the drum.

A further feature of the present invention is a less expensive method of drying clothes.

SUMMARY OF THE INVENTION

A device and method is provided for increasing the rate of drying in a clothes dryer. The clothes dryer has a rotatable drum or basket with an emissive coating on the internal drum wall to reflect energy inside the dryer. By reflecting the energy inside the rotatable drum, the rate of heat transfer is increased and thus the drying time is decreased. Infrared and convection heat sources are provided for drying the clothes in the drum.

DETAILED DESCRIPTION OF THE PREFERRED EMBODIMENT

Figure 1:
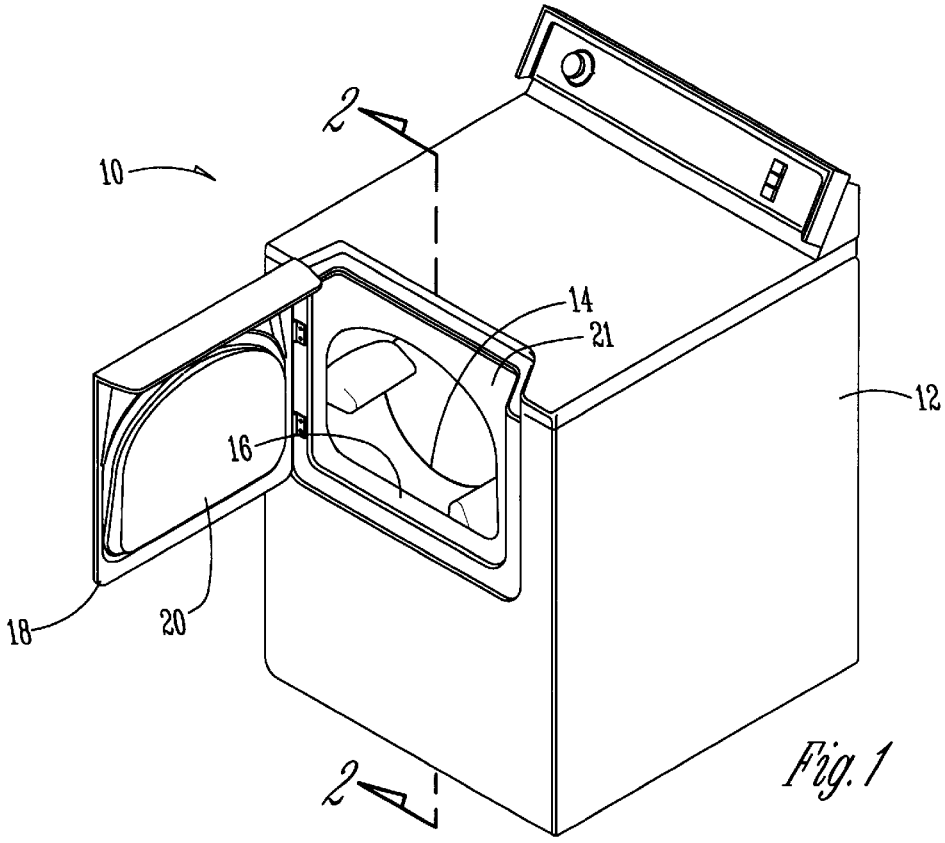
FIG. 1 is a perspective view of a clothes dryer of the present invention.

Referring to the drawings, a clothes dryer 10 according to the present invention includes a cabinet 12 with a rotatable drum or basket 14 mounted therein. The cabinet 12 includes an access opening 16 for access to the interior of the drum 14. A door 18 is mounted to the cabinet 12 for movement between open and closed positions, with a door plug 20 adapted to sealingly engage the access opening 16 when the door 18 is closed.

Figure 3:
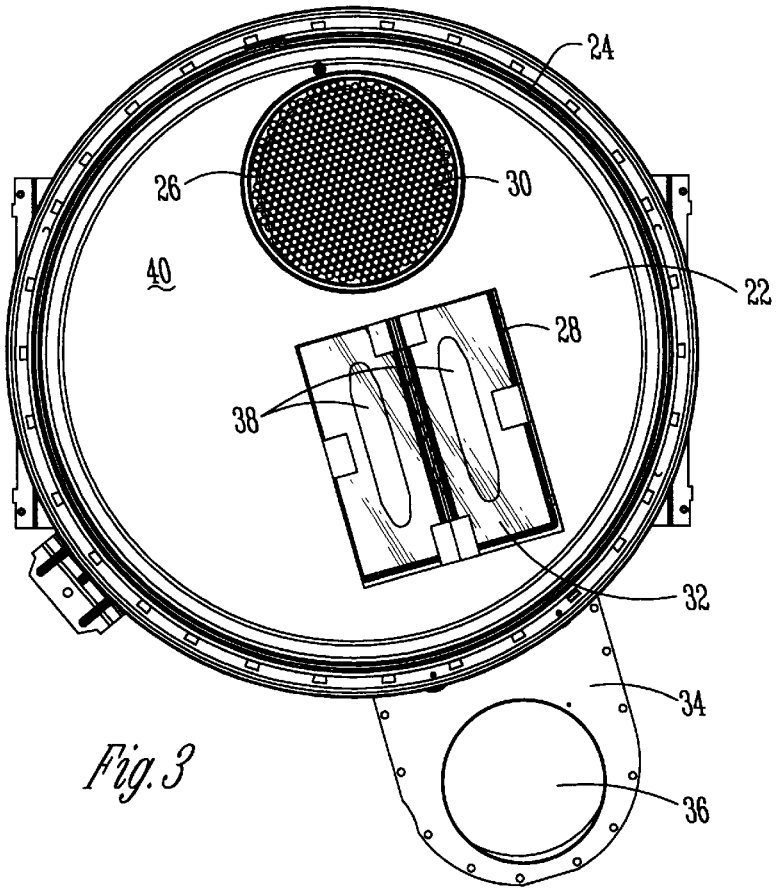
FIG. 3 is a front elevation view of the rear bulkhead with the attached heat source housing for the clothes dryer.

The drum 14 is cylindrical and mounted for rotation between a stationary front bulkhead 21 and a stationary rear bulkhead 22. The rear bulkhead 22 includes a perimeter edge 24 which provides a conventional seal with the drum 14. The rear bulkhead 22 includes first and second openings 26, 28, as best seen in FIG. 3. The second opening 28 is covered with glass 32.

A housing 34 is mounted on the rearward side of the rear bulkhead 22. The housing 34 includes an air inlet 36 and an air outlet 37, such that the housing 34 defines an airflow channel for heated air from the air inlet 36 to the air outlet opening 26 in the rear bulkhead 22. The air outlet 37 has a grated cover 30 to prevent clothes from entering the housing 34. The housing 34 also encloses infrared heating elements 38, such as IR lamps, which are positioned behind the glass 32 adjacent the rear bulkhead 22.

Figure 2:
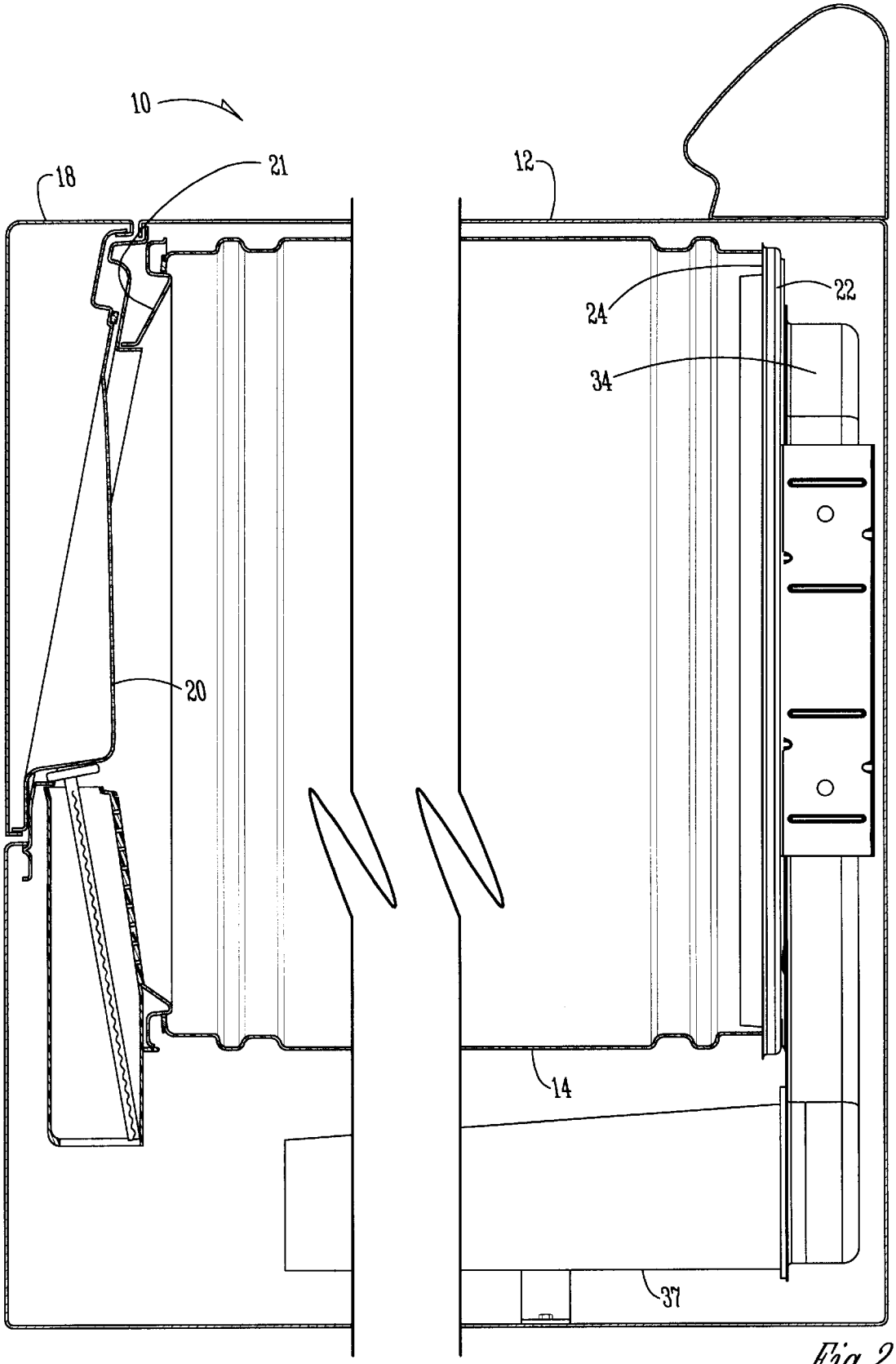
FIG. 2 is a sectional view of the dryer taken along lines 2—2 of FIG. 1.
Figure 4:
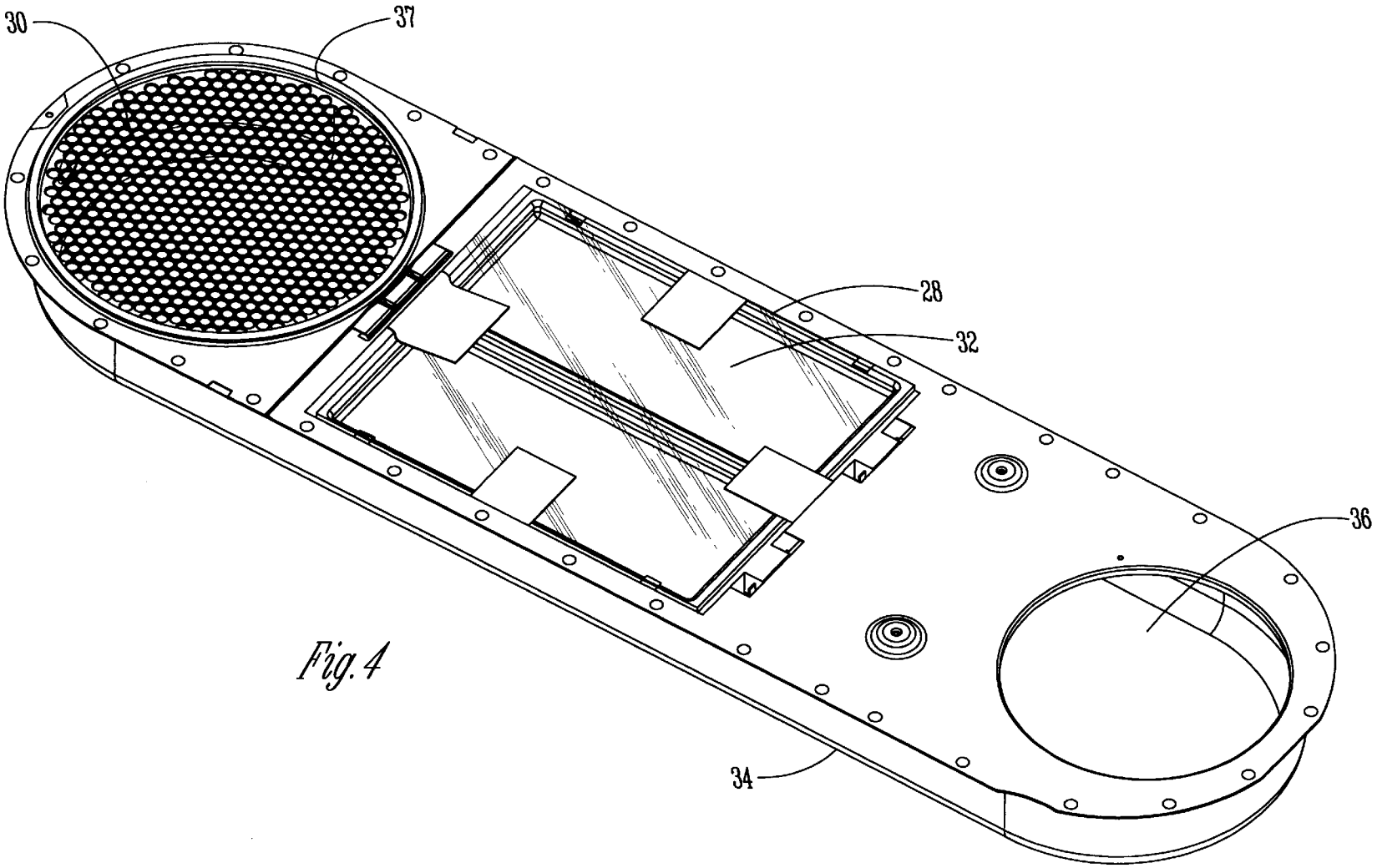
FIG. 4 is a perspective view of the heat source housing for the dryer.

As best shown in FIG. 2, the lower end of the housing 34 engages a heater assembly 37. Heater assembly 37 houses the electric or gas heat source for convection airflow into housing 34 and into drum 14 through grated cover 30.

The interior of the drum 14, the inside surface 40 of the bulkhead 22, and the door plug 20 are coated with an emissive coating such as "radiance" supplied by Chemrex, Inc., Shakopee, Minn. Preferably, the coating is an electrostatically applied powder coating. The emissive coating provides a reflective surface for the infrared heat from the IR elements 38 and for the convective heat input through grated cover 30. It has been found that absent the emissive coating, the dryer 10 reflects approximately 10% of the energy from conventional convection forced air-drying. With the emissive coating, approximately 40% of the energy from the IR element 38 and the convection air is reflected. Therefore, the dryer energy consumption is reduced substantially, since the heat transfer through the wall of the drum 14 is reduced. The increase in reflective energy inside the rotatable drum causes heat transfer to increase and thus drying time to decrease. It is also known that manufacturing the drum 14 from other materials such as aluminized steel will provide a highly reflective surface.

In a preferred embodiment, the heat source is an infrared heat source in combination with a convectional heat air. The convection drying method, which is prevalent in conventional dryers, is limited as the cloth temperature approaches the wet bulb temperature in the dryer interior. As the clothes reach the wet bulb temperature, energy absorption ceases. Using a combination of radiant and convection energy, the cloth temperature is not being limited to the wet bulb temperature. Heat transfer will continue beyond the wet bulb temperature, since the radiant energy will directly heat the water in the clothes. The resulting cloth temperature will be something higher than the wet bulb temperature and below the boiling point of water. This condition will increase the rate of heat transfer and thus the drying rate. The drying time is reduced even further as the radiant energy from the infrared source is radiated back inside the rotatable drum.

It is understood that the dryer of the present invention will function without the convection air to dry clothes. The combination of convection and radiant heat, along with the low emissive interior coating, provides the best drying efficiencies.

The preferred embodiment of the present invention has been set forth in the drawings, specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. An improved clothes dryer having a rotatable drum for holding clothes to be dried, an access opening to the drum, a door for closing the access opening, and a heat source for drying the clothes, the improvement comprising:

an emissive coating on the drum to reflect heat energy from the heat source within the drum so as to enhance drying of the clothes.

2. The door of claim 1 wherein the door has an emissive coating to reflect energy from the heat source.

3. The heat source of claim 1 wherein the heat source is an infrared heat source.

4. The heat source of claim 1 wherein the heat source is a convection heat source.

5. The heat source of claim 1 wherein the heat source includes an infrared heat source and a convection heat source.

6. An improved method of drying clothes in a clothes dryer having a rotatable drum for holding clothes to be dried, an access opening to the drum, a door for closing the access opening, and a heat source for drying the clothes, the method comprising:

reflecting heat energy from the heat source off an emissive coating on the drum to enhance drying of the clothes.

7. The method of claim 6 wherein the door has an emissive coating, the method further comprising reflecting energy from the heat source off the emissive coating on the door.

8. The method of claim 6 further comprising providing infrared heat from the heat source.

9. The method of claim 6 further comprising providing convection heat from the heat source.

10. The method of claim 6 further comprising providing infrared heat and convection heat from the heat source.

11. An improved clothes dryer having a rotatable drum for holding clothes to be dried, an access opening to the drum, a door for closing the access opening, and a heat source for drying the clothes, the improvement comprising:

a reflective coating on the drum to reflect heat energy from the heat source within the drum so as to enhance drying of the clothes.

12. The door of claim 11 wherein the door has a reflective coating to reflect energy from the heat source.

13. The heat source of claim 11 wherein the heat source is an infrared heat source.

14. The heat source of claim 11 wherein the heat source is a convection heat source.

15. The heat source of claim 11 wherein the heat source includes an infrared heat source and a convection heat source.

16. The improved clothes dryer of claim 11 wherein the reflective coating reflects at least 20% of the energy from the heat source.

* * * * *